US007533714B2

(12) United States Patent
Guerche et al.

(10) Patent No.: US 7,533,714 B2
(45) **Date of Patent: *May 19, 2009**

(54) PROCESS FOR MANUFACTURING CERAMIC CORES FOR TURBOMACHINE BLADES

(75) Inventors: Didier Guerche, Conflans Ste Honorine (FR); Serge Prigent, Asnieres sur Seine (FR); Patrick Wehrer, La Garenne Colombes (FR)

(73) Assignee: SNECMA, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/742,850

(22) Filed: May 1, 2007

(65) Prior Publication Data

US 2007/0261811 A1 Nov. 15, 2007

(30) Foreign Application Priority Data

May 10, 2006 (FR) ..... 06 51682

(51) Int. Cl.
*B22C 9/10* (2006.01)
*B22C 9/12* (2006.01)

(52) U.S. Cl. ..... 164/28; 164/17; 164/369

(58) Field of Classification Search ..... 164/28, 164/228, 15, 17, 516, 369
See application file for complete search history.

(56) References Cited

U.S. PATENT DOCUMENTS

| | | | | |
|---|---|---|---|---|
| 5,332,537 | A * | 7/1994 | Hens et al. | 264/496 |
| 5,465,780 | A * | 11/1995 | Muntner et al. | 164/516 |
| 6,375,880 | B1 * | 4/2002 | Cooper et al. | 264/138 |
| 7,246,653 | B2 * | 7/2007 | Judet | 164/516 |
| 7,458,411 | B2 * | 12/2008 | Prigent et al. | 164/28 |
| 2006/0219379 | A1 * | 10/2006 | Prigent et al. | 164/28 |

FOREIGN PATENT DOCUMENTS

| | | |
|---|---|---|
| EP | 1 557 229 A2 | 7/2005 |
| EP | 1 661 642 A1 | 5/2006 |

* cited by examiner

*Primary Examiner*—Kevin P Kerns
(74) *Attorney, Agent, or Firm*—Oblon, Spivak, McClelland, Maier & Neustadt, P.C.

(57) ABSTRACT

A process for manufacturing a ceramic foundry core having at least one thin region with a thickness "e", in particular in of a turbomachine blade trailing edge, including the forming in a mold of a mixture including a ceramic particle filler and an organic binder, the extraction of the core from the mold, the binder removal and consolidation heat treatment of the core. The process is one in which a core is formed in the mold, the region of this core being thickened relative to the thickness "e" by an overthickness E and in which the overthickness is machined after the core has been extracted from the mold and before or after the heat treatment operation. In particular, the machining is carried out mechanically by milling, either with removal of chips on the cores before firing, or by abrasion on the fired cores.

14 Claims, 3 Drawing Sheets

PROCESS FOR MANUFACTURING CERAMIC CORES FOR TURBOMACHINE BLADES

BACKGROUND OF THE INVENTION

The present invention relates to the manufacture of parts such as metal turbomachine blades, which have internal cavities of complex geometry forming especially cooling circuits, using the technique of lost-wax casting.

The manufacture of such blades involves a pattern made of wax or equivalent material, which comprises an internal part forming a casting core and the configuration of the cavities of the blade. To form the pattern, a wax injection mold is used, in which the core is placed and wax injected into it. The wax pattern is then dipped several times in slips consisting of a suspension of ceramic particles so as to form a shell mold. The wax is removed and the shell mold fired. The blade is obtained by pouring molten metal into the shell, this metal occupying the voids between the inner wall of the shell mold and the core. Thanks to a seed or an appropriate selector and controlled cooling, the metal solidifies in the desired structure. Depending on the nature of the alloy and the expected properties of the part resulting from the casting operation, the alloy may undergo directional solidification giving a columnar structure (DS), directional solidification giving a single-crystal structure (SX) or equiaxed solidification (EX), respectively. The two first families of parts relate to superalloys for parts exposed to high stresses, both thermal and mechanical, in the turbojet, such as the HP turbines' blades.

After the alloy has solidified, the shell and the core are shaken out, giving the desired blade.

DESCRIPTION OF THE PRIOR ART

The foundry cores used are made of a ceramic of generally porous structure. They are produced from a compound consisting of a refractory filler in the form of particles and a relatively complex organic fraction forming a binder. Examples of compositions are given in patents EP 328 452, FR 2 371 257 and FR 1 785 836. As is known, foundry cores are formed by molding while using for example press injection. This forming operation is followed by a binder removal operation during which the organic fraction of the core is removed by a means such as sublimation or thermal degradation, depending on the materials used. This results in a porous structure. The core is then consolidated by a heat treatment in a furnace. A finishing step is possibly needed to remove and deflash the remnants of parting lines and obtain the geometry of the core. Abrasive tools are used for this purpose. It may also be necessary to reinforce the core so that it is not damaged in the subsequent usage cycles. In this case, the core is impregnated with an organic resin.

For the purpose of reducing the cycle time for obtaining cores, it is also possible to manufacture a blank core and to machine the slots and partitions when the core is in the green state. This is described in the patent application filed in the name of the present Applicant, namely FR 04/52789.

The geometry of the cores is always more complex, in particular the walls of certain regions are always thinner. Consequently, the filling limits are often reached and require the development of more fluid slurries or the use of higher pressure for filling the impressions of the mold.

Thick cores are dimensionally more stable owing to the composition of the slurries. For example, the binder/filler ratio and the proportion of fine ceramic particles and coarse ceramic particles may be adapted.

Within the context of engines under development and those in mass production, the injection method of the prior art therefore does not make it possible to respond economically to design changes to the core, in particular the need to thin fine areas with a thickness of less than 0.4 mm.

To solve these problems, a known technique consists in manufacturing ceramic cores in a mold in which the thin and/or critical areas are obtained either by using ceramic slurries that are more fluid or also by modifying the injection parameters and especially flow rates or pressures above those under conventional operating conditions. However, this technique has certain drawbacks. Firstly, the ceramic material possess abrasive properties, and the shear generated by the new filling conditions is the cause of premature wear of the thin areas of the tooling. This results in many periods when production has stopped and incurs a high cost of maintaining the tooling in the proper state. Secondly, despite optimizing the filling conditions and despite using numerical simulation, certain thin areas "freeze" the filling front. It follows that filling can take place only by rebonding of what is called "cold" slurry, that is to say a slurry at a temperature that is not optimum for having a strong bond. These filling conditions are the origin of crack indicators, which result in large numbers of cores being scrapped after they have been ejected and checked. These defects may also be revealed after the binder removal and firing heat treatment, which means that they incur an even higher cost.

SUMMARY OF THE INVENTION

According to the invention these problems are remedied with a process for manufacturing a foundry core comprising at least one thin wall or region with a thickness "e" between 0.1 and 0.5 mm, for example on the trailing edge of turbomachine blade, comprising the forming in a mold of a mixture comprising a ceramic particle filler and an organic binder, the extraction from the mold, the binder removal and consolidation heat treatment of the core. This process is one in which a core is formed in said mold, said region of this core being thickened relative to the thickness "e" by an overthickness E, and in which said overthickness is machined after the core has been extracted from the mold until said thickness "e" is obtained so as to create a channel of sufficient opening for the flow of said mixture during its injection into the mold. The machining operation may be carried out before or after heat treatment.

Whereas a person skilled in the art seeks to develop materials of lower viscosity or to modify the injection parameters, in particular the flow rate or the pressure, the present invention results from a different approach, that of reducting the pressure drop associated with the definition of the cavity to be filled.

The pressure drop is expressed by the following equation: $P=\eta QL/\pi D^4$, which links the pressure (P) to the viscosity ($\eta$), to the flow rate (Q), to the length (L) and to the diameter (D).

In the invention, the flow diameter in a narrow region is varied by increasing it so as to create a sufficient opening for flow of the slurry.

Thus, any particular development is overcome, even wall thicknesses being reduced down to 0.1 mm.

Thanks to the invention, the cost of obtaining foundry cores is reduced. Although the quantity of cores having injection and/or firing crack indicators obtained by injection into a mold with a thin trailing edge reaches several tens of a percent, the solution does make it possible to achieve a substantial improvement in quality and to produce cores having thinner trailing edges than with the process of the prior art. The intended limit is down to thicknesses of 0.1 mm.

Advantageously, the thickened region of the core is mechanically machined by milling, although this can also be carried out by hand.

More particularly, the core comprises 80 to 85% mineral filler and 15 to 20% organic binder. The composition advantageously corresponds to one of those described in patent EP 328 452 in the name of the Applicant. A not very fluid composition is sought, which must have a low variation in shrinkage in mass production of the cores.

The present invention does allow a single slurry to be formulated for the manufacture of all blade cores, whereas the process of the prior art requires tailored slurry formulations. In particular, it is necessary to provide fluid slurries for cores designed with trailing edges for which the thicknesses are less than 0.4 mm.

According to another feature, the machining is carried out by successive passes of the tool, a specified thickness of material between 0.05 and 2 mm being removed at each pass. In particular, before firing the machining is carried out by means of a milling cutter to remove material, whereas after firing the machining is carried out by means of a tool, often a diamond-tipped tool, by removal of material on an at least three-axis milling machine and preferably a four-axis or five-axis milling machine. It is possible to carry out the machining automatically by this means.

This technique makes it possible to machine an unfired core on the basis of an existing CADCAM (computer-aided design and manufacture) file without being penalized by contractions of the core during the firing step, which are not always the same. The unfired core has the dimensions of the mold in which it is manufactured. Advantageously, before firing, the cores are geometrically identical.

In this way forms having variable thicknesses corresponding to the various structural elements of the core are produced. Other forms are possible.

BRIEF DESCRIPTION OF THE DRAWINGS

Other features and advantages will become apparent on reading the following description of one method of implementing the process of the invention with reference to the appended drawings in which.

The following description corresponds to the invention applied to the formation of a foundry core for a high-pressure turbine blade in a gas turbine engine for aeronautical or terrestrial use. This presentation is not limiting.

Figure 1:
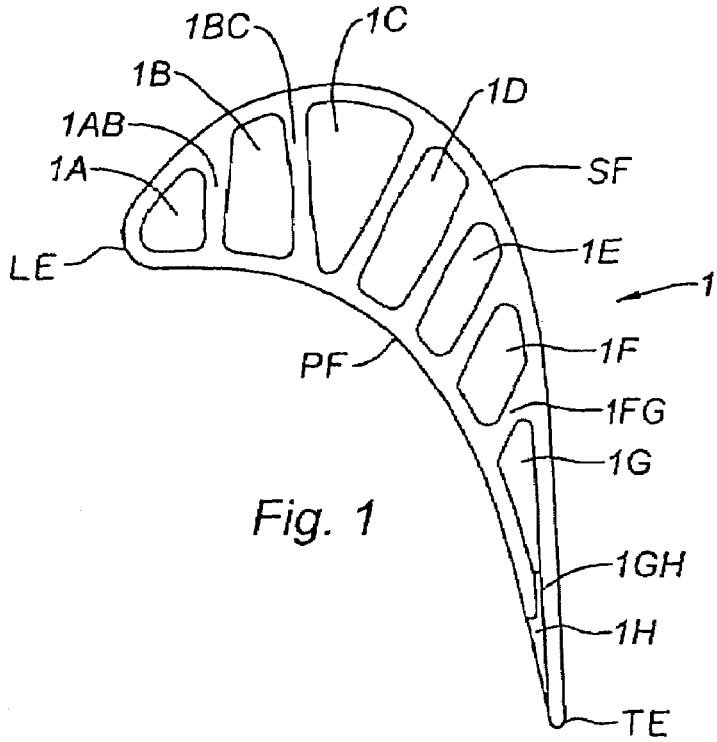
FIG. 1 is a sectional view of a cooled turbine blade.

As may be seen in FIG. 1, a turbine blade 1 comprises a pressure face PF, a suction face SF, a leading edge LE and a trailing edge TE. When this is a high-pressure turbine blade of a gas turbine engine for aeronautical use, the blade includes internal cavities, here seven cavities, namely 1A to 1G. The trailing edge has a cavity 1H extending parallel to it. It is supplied from the last cavity 1G via a plurality of mutually parallel calibrated channels 1GH for exhausting the coolant, which is air taken from the compressor.

The cavities are separated from each other by partitions, namely 1AB, 1BC, . . . 1FG. When these blades are manufactured by casting a molten metal, a core must be incorporated into the shell mold, this core occupying the voids of the cavities to be formed in the blade. This core, as may be gleaned from FIG. 1, is complex.

Figure 2:
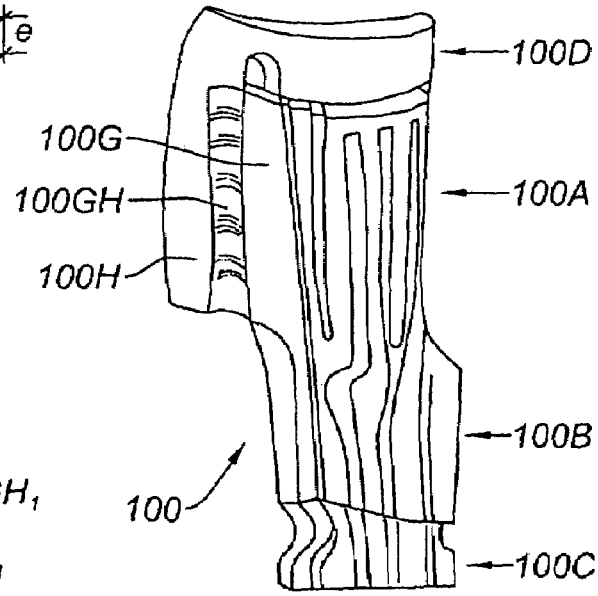
FIG. 2 is a general view of a cooled blade core.

FIG. 2 shows a core 100 obtained from a mold. It comprises a portion corresponding to the cavities of the airfoil 100A, a portion 100B corresponding to the cavities of the root of the blade and a portion 100C forming a handle for gripping the blade during manufacture. At the tip of the blade, there is also a portion 100D corresponding to what is referred to in the jargon of the field as a "squealer".

Figure 3:
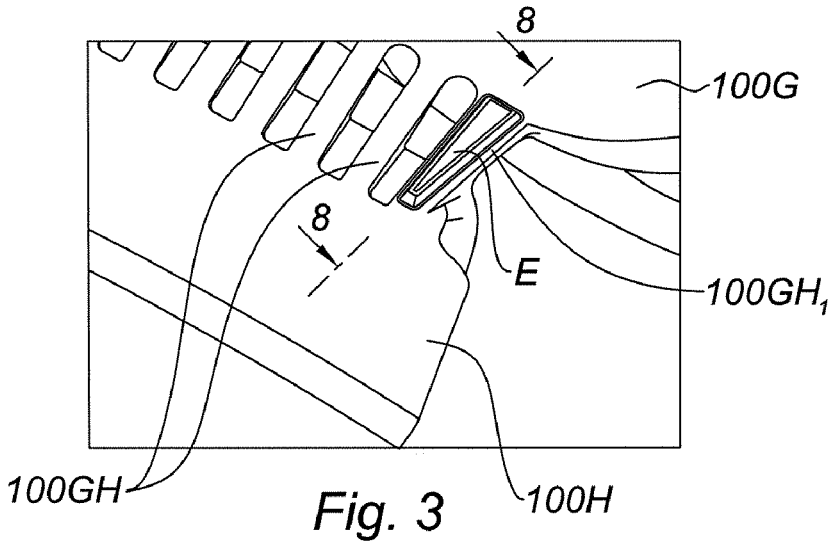
FIG. 3 is a view of a core trailing edge region having an overthickness according to the invention.
Figure 4:
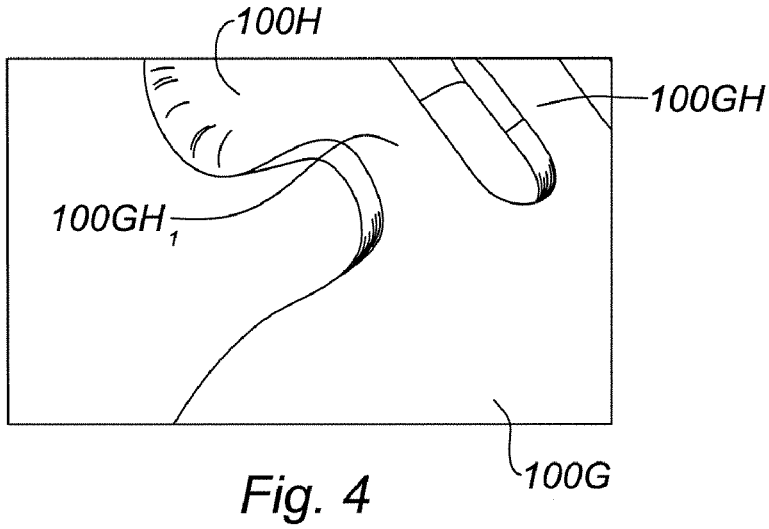
FIG. 4 is a view of a portion of the core trailing edge after the overthickness has been machined.

The trailing edge of the core i.e. the portion referenced 100H resulting in the formation of the cavity 1H of FIG. 1, and the tenons 100GH resulting in the formation of the channels 1GH of FIG. 1 are shown in FIG. 3 or FIG. 4. The particular case of the first tenon 100GH1 according to the invention will be discussed later.

This core is produced by injecting molding in a mold in which the thin regions formed by the tenons 100GH must be filled. The usual technique consists in designing the mold with subparts that have a certain mobility in order to be able to extract the core after injection of the material into the mold and its solidification. As explained above, the injection into these regions is more complicated the thinner they are.

The object of the invention is to produce a core having such a complex structure without having to develop more fluid slurries or to increase the injection parameters such as the pressure or flow rate.

According to the invention, a modified mold is produced, that is to say a mold in which the core after molding has at least one thin region that is thickened.

Figure 8:
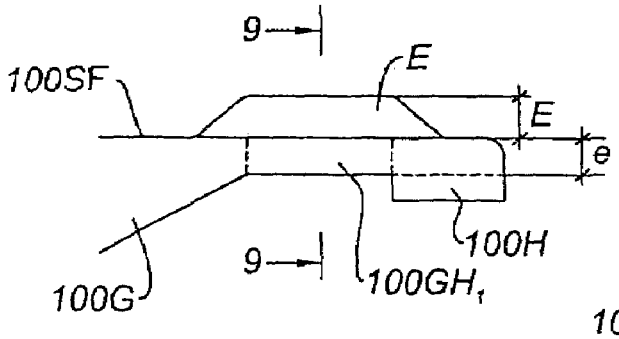
FIG. 8 shows, in section on 8-8, the first tenon of FIG. 3.
Figure 9:
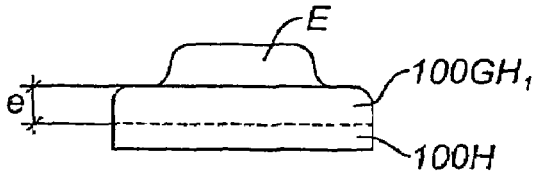
FIG. 9 shows, in section on 9-9, the first tenon of FIG. 8.

The thickened thin region of the first tenon 100GH1 is obtained by suitably shaping the mold at this point in order to obtain such a thickened region for the first tenon 100GH1. The first tenon is the first seen from the root of the blade via which the core slurry is injected. This portion is shown in section in FIGS. 8 and 9. FIG. 8 shows the overthickness E of the tenon 100GH1 relative to the suction face 100SF of the core 100. The surfaces on the suction face side of the portions 100G and 100H lie substantially in the same plane, with the exception of this overthickness. This overthickness is determined according to the final thickness "e" that it is desired to obtain for the tenon 100GH1 and of the quality of the slurry that is injected. A channel is created with a sufficient opening for flow of the slurry during injection. In cross section, shown in FIG. 9, the outline of the overthickness E takes into account the rounded edges of the tenon. The radiusing of the rounded edges of the tenon may also be carried out by machining.

Preferably, the slurry used comprises an organic binder combined with a mineral filler. For example, the mixture is made according to the teaching of patent application EP 328 452. The core has good handling behavior and its constitution allows it to be worked by means of a milling tool by removal of chips or by abrasion.

Figure 7:
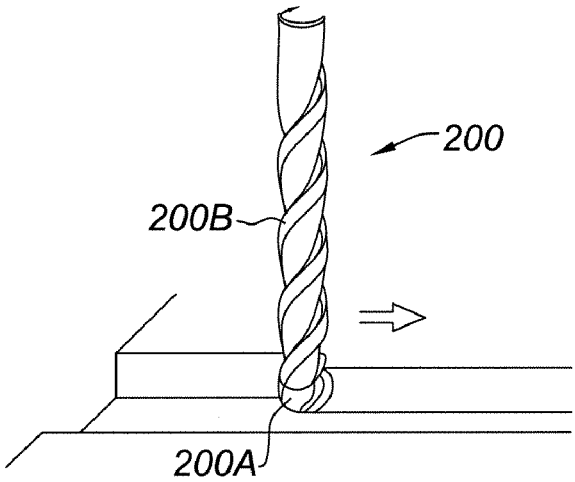
FIG. 7 shows the method of machining by means of a milling cutter.

After the core has been manufactured with this overthickness E on the first tenon, the next step consists in machining, in this core blank, the thickened region or regions. The machining is advantageously carried out by means of a tool as shown in FIG. 7. This is a milling cutter 200 having a cutting end 200A and a helical cutting edge or thread along its shank 200B. The milling cutter is moved perpendicular to the surface to be machined. The speed of the tool and that of its displacement are fixed. In this way the forces on the material are limited and the tool prevented from bending.

It is preferred to use a numerical control machine tool of the type having five axes of displacement, for example three axes for positioning the milling cutter in space and two axes for positioning the core. This machine can be easily programmed in order to automate the machining of the cavities, as the case may be.

FIG. 4 shows the trailing edge region of the core after it has been machined. The channels have the dimensions, in particular the thickness that they will form, apart from shrinkage, in the part upon casting the molten metal into the shell mold.

Once the machined core has been fired, it undergoes the following treatments, known per se, in the process from manufacturing foundry cores, namely binder removal, that is to say the removal of the organic binder. For this purpose, the core is heated to a sufficient temperature to degrade the organic components that it contains. The other steps consist in subsequently heating the core to the temperature for sintering the ceramic particles of which it is made. If additional consolidation is necessary, impregnation with an organic resin is carried out.

For cores machined after firing, is passed directly to the finishing and checking operations.

Figure 5:
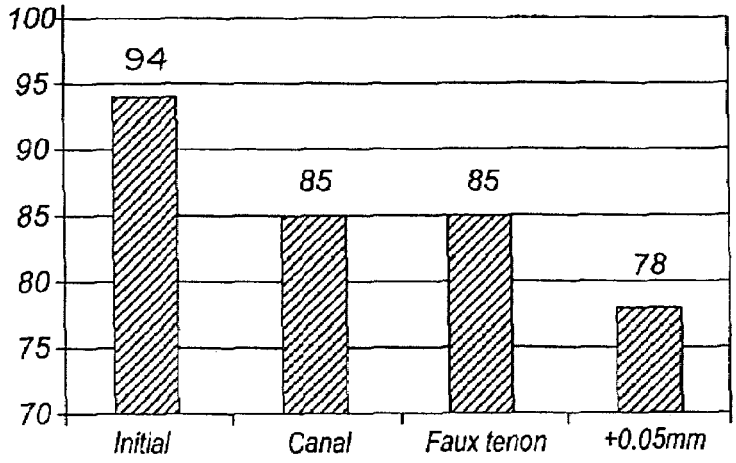
FIG. 5 is a graph of the variation in injection pressure as a function of the means used to obtain the desired trailing edge geometry.
Figure 6:
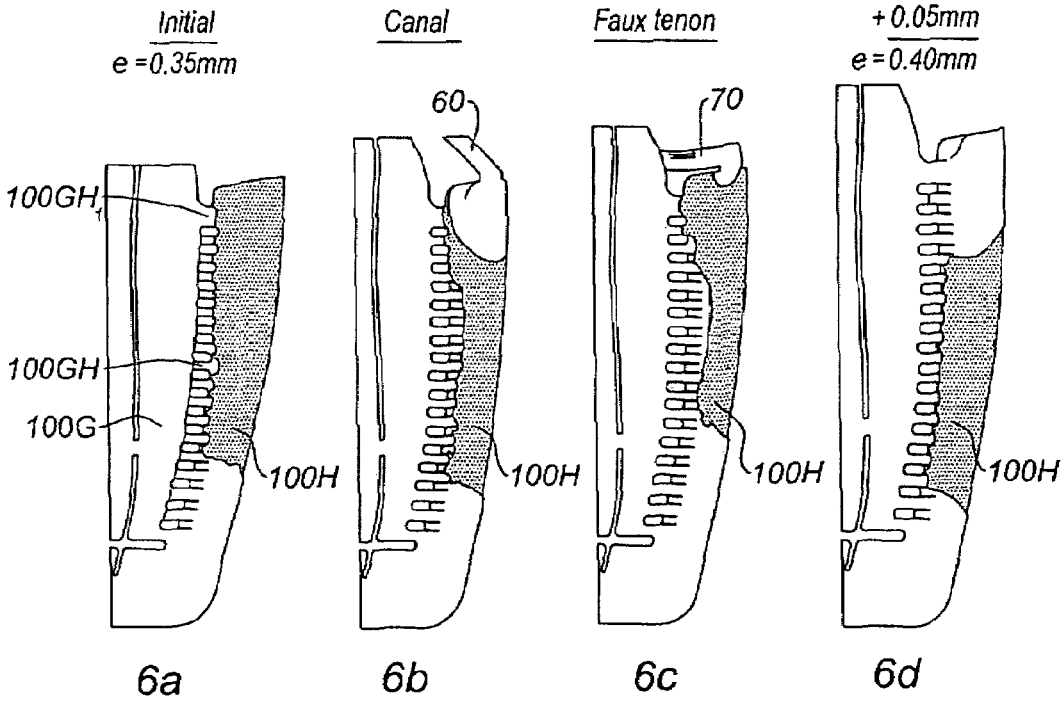
FIG. 6 shows the filling of the mold as a function of the means of FIG. 5.

To demonstrate the benefit of the present solution, comparative trials were carried out with reference to FIGS. 5 and 6.

FIG. 6*a* shows a phase in the filling of a mold of the prior art, indicated by the hatched lines. The thickness of the channels for forming the tenons in this example is 0.35 mm. It may be seen that the slurry is introduced via the root region of the blade and advances toward the top of the mold. The slurry is slowed down in its flow through the regions of small thickness. It cools even before having passed these regions. The slurry must therefore get past these regions. It follows that at the moment when the two propagation fronts come together, the slurry is not sufficiently fluid for a strong weld to form.

On the graph in FIG. 5, it is shown that the necessary pressure is 94 units of pressure.

FIG. 6*b* shows a channel 60 on the side with the region 100H in order for the feed to be more direct. In fact, the injection pressure is lower—85 units of pressure suffice. However the weld is still not satisfactory as the slurry front remains fixed in the channels of the tenons.

FIG. 6*c* shows the addition of a false tenon 70. The result is substantially the same as previously—the pressure is 85 units of pressure.

In FIG. 6*d* the mold has been hollowed out so as to form, on the first tenon, an overthickness according to the invention. Compared with FIG. 5, it may be seen that an injection pressure of 78 units of pressure is sufficient for the propagation front of the slurry not to be blocked in the channel. This allows the trailing edge region to be filled through the channels. It follows that no mechanical weakness affects the tenon region.

The figures essentially show the thickening of the first tenon of the core but this may be applied to all the tenons. This technique therefore makes it possible more generally to produce portions of the core that are very thin and narrow, such as the portion of the core lying close to the trailing edge and having channels for passage of the air escaping from inside the blade at the end of the cooling circuit and injected into the gas stream. However, the machining may be extended to any portion of the core for which the same freedom-of-flow problem arises.

The invention claimed is:

1. A process for manufacturing a foundry core for casting a turbomachine blade, said core comprising at least one thin region with a thickness between 0.1 and 0.5 mm corresponding to a cavity in said turbomachine blade, said process comprising:

providing a mold, forming a core in said mold by injecting a mixture into said mold, said mixture comprising a ceramic particle filler and an organic binder, wherein said mold is configured so as to provide, during said injecting, a channel with an opening sufficient to promote a flow of said mixture through said channel during said injecting and wherein, upon cooling, said mixture within said channel forms a thickened region in said core, said thickened region of said core having a thickness thicker than said thickness of said thin region, extracting said core from the mold, removing the binder from said core, and consolidating the core by heat treatment, wherein said process comprises a step of machining said thickened region after said step of extracting said core from said mold, and wherein said machining is performed on said thickened region so as to obtain said thin region of said core.

2. The process as claimed in claim 1, wherein the machining is carried out before the heat treatment.

3. The process as claimed in claim 2, wherein the machining is carried out mechanically by milling with removal of chips.

4. The process as claimed in claim 1, wherein the machining is carried out after the heat treatment.

5. The process as claimed in claim 4, wherein the machining is carried out mechanically by abrasion.

6. The process as claimed in claim 5, wherein the machining is carried out with a milling cutter by removing material on an at least three axis milling machine.

7. The process as claimed in claim 1, wherein the thin region lies close to a leading edge of said core and forms a tenon configured to form an air channel for exhausting air thereby internally cooling said turbomachine blade.

8. The process as claimed in claim 7, wherein said mixture is fed in the mold at a location corresponding to said tenon.

9. The process as claimed in claim 7, wherein the machining includes a step of radiusing a surface of the tenon.

10. The process as claimed in claim 1, wherein said core comprises a plurality of thin regions, and said mold is configured to provide an overthickness for several thin regions.

11. The process as claimed in claim 1, wherein said thickened region, before said step of machining, is thicker than said thin region by an overthickness of at least about 14% of said thin region.

12. The process as claimed in claim 1, wherein said mold is configured to provide said channel during said injecting such that an injection pressure of said mixture is less than that of another process that is free of a step of forming said thickened region in said core.

13. The process as claimed in claim 12, wherein said injection pressure of said process is less than that of said another process by at least about 17%.

14. The process as claimed in claim 1, wherein said thickened region has a shape that is different from that of said thin region.

* * * * *